US007594283B2

(12) United States Patent
Yoon

(10) Patent No.: US 7,594,283 B2
(45) Date of Patent: Sep. 29, 2009

(54) NOZZLE ASSEMBLY FOR BIDET

(75) Inventor: Sun Hyung Yoon, Buchun-si (KR)

(73) Assignee: Samhong Tech. Co. Ltd., Seoul (KR)

( * ) Notice: Subject to any disclaimer, the term of this patent is extended or adjusted under 35 U.S.C. 154(b) by 724 days.

(21) Appl. No.: 11/198,990

(22) Filed: Aug. 8, 2005

(65) Prior Publication Data

US 2006/0070173 A1 Apr. 6, 2006

(30) Foreign Application Priority Data

Oct. 5, 2004 (KR) ..... 10-2004-0079138

(51) Int. Cl.
*E03D 9/08* (2006.01)

(52) U.S. Cl. ..... 4/420.4

(58) Field of Classification Search ..... 4/420.4, 4/443, 444, 447, 448
See application file for complete search history.

(56) References Cited

U.S. PATENT DOCUMENTS 4,704,748 A * 11/1987 Takeda et al. ..... 4/420.4
4,987,617 A * 1/1991 Furukawa et al. ..... 4/448

* cited by examiner

*Primary Examiner*—Huyen Le
(74) *Attorney, Agent, or Firm*—Lowe Hauptman Ham & Berner, LLP

(57) ABSTRACT

A nozzle assembly for a bidet includes a washing nozzle, a bidet nozzle mounted under the washing nozzle, a driving motor driving the washing nozzle and/or the bidet nozzle, a gear train, and a nozzle case for receiving the washing and bidet nozzles and the gear train. The gear train includes a driving gear connected to the driving motor to transmit rotational force of the driving motor, a first nozzle gear reciprocating the washing nozzle by receiving the rotational force from the driving gear, and a second nozzle gear reciprocating the bidet nozzle by receiving the rotational force from the driving gear.

28 Claims, 18 Drawing Sheets

NOZZLE ASSEMBLY FOR BIDET

BACKGROUND OF THE INVENTION

1. Field of the Invention

The present invention relates to a bidet, and more particularly, to a nozzle assembly for a bidet that can perform the washing operation by reciprocally operating different nozzles according to washing areas such as genital and anal areas.

2. Description of the Related Art

A bidet is generally installed on a seat of a toilet stool so that a person sits to wash his/her genital and anal areas using washing water sprayed from washing and bidet nozzles without using toilet paper. The bidet includes a washing nozzle for washing the anal area and a bidet nozzle for washing the genital area.

The washing and bidet nozzles are arranged side by side on an identical horizontal plane. Therefore, when a user pushes a wash button after stool, the bidet nozzle is projected forward to spray the washing water to the user's anal area. At this point, in order to accurately spray the washing water to the user's anal area, a nozzle cap rotates at a predetermined angle. When the washing operation is finished, the washing nozzle is returned to its initial position.

In addition, when the user pushes a bidet button, the bidet nozzle is projected forward and an angle of a nozzle cap is adjusted so that the washing water can be accurately sprayed on the genital area of the user.

A bidet having the washing and bidet nozzles arranged side by side on the identical horizontal plane is disclosed in Korean utility model No. 20-0262725 to the applicant of this invention.

In addition, the washing and bidet nozzles may be arranged side by side in a vertical direction. In this case, a volume occupied by the nozzles can be reduced as compared with a type where the washing and bidet nozzles are arranged side by side on the identical horizontal plane. An operation method of the nozzles arranged side by side in the vertical direction is disclosed in Korean utility Model No. 20-0243354.

Here, in the case of the nozzles arranged side by side on the identical plane, since the two nozzles are arranged on left and right sides, they cannot be located right under the genital and anal areas. That is, the nozzles are to be slightly deviated from a point located right under the genital and anal areas.

Accordingly, when the user pushes the washing or bidet button, the washing or bidet nozzle is projected forward, after which the nozzle cap on which an injection hole is formed rotates so that the injection hole is oriented to take good aim at the genital or anal area. Furthermore, even when the nozzle cap rotates by a predetermined angle, there may be frequent occasions that the injection hole cannot take good aim at the genital or anal area. As a result, the washing water may be sprayed to an undesired region of the user or to user's cloth, thereby making the user unpleasant.

In addition, in the case of the bidet where the nozzles are arranged side by side in a vertical direction, the nozzles are designed to be projected forward by water pressure. That is, when the user pushes the bidet or washing button after stool, a step motor rotates clockwise or counterclockwise. By the rotation of the step motor, a fluid passage adjust value rotates to allow the washing water to be introduced into a valve case. By pressure of the introduced washing water, the bidet or washing nozzle is advanced.

However, in this nozzle projecting method using the water pressure, the operation of the bidet or washing nozzle may not accurately realized when the pressure of the washing water introduced into the bidet is too low. That is, in order to allow the bidet and washing nozzle to be advanced to an accurate location, a water pressure higher than a predetermined level is required. However, the pressure of the washing water introduced into the bidet is lowered at a location where the water pressure is lower than the predetermined level. As a result, the bidet and washing nozzles cannot be fully advanced due to the low water pressure. As a result, the washing water is sprayed to an undesired portion of the user, thereby making the user unpleasant and deteriorating the washing efficiency.

SUMMARY OF THE INVENTION

Accordingly, the present invention is directed to a nozzle assembly for a bidet that substantially obviates one or more problems due to limitations and disadvantages of the related art.

An object of the present invention is to provide a nozzle assembly for a bidet, which can reduce a volume of the bidet by arranging bidet and washing nozzles side by side in a vertical direction and can accurately locate the bidet or washing nozzle to a desired location regardless of a pressure level of washing water introduced into the bidet by using a special nozzle operating device.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a nozzle assembly for a bidet, including: a washing nozzle; a bidet nozzle mounted under the washing nozzle; a driving motor driving the washing nozzle and/or the bidet nozzle; a gear train comprising a driving gear connected to the driving motor to transmit rotational force of the driving motor, a first nozzle gear reciprocating the washing nozzle by receiving the rotational force from the driving gear, and a second nozzle gear reciprocating the bidet nozzle by receiving the rotational force from the driving gear; and a nozzle case for receiving the washing and bidet nozzles and the gear train.

In another aspect of the present invention, there is provided a nozzle assembly for a bidet, including: washing and bidet nozzles that are arranged side by side in a vertical direction; rack wires connected to rear ends of the washing and bidet nozzles, respectively; a first nozzle gear having gear teeth engaged with the rack wire connected to the rear end of the washing nozzle; a second nozzle gear having gear teeth engaged with the rack wire connected to the rear end of the bidet nozzle; and a driving gear transmitting rotational force to the first nozzle gear and/or the second nozzle gear.

In a still another aspect of the present invention, there is provided a nozzle assembly for a bidet, including: a washing nozzle; a bidet nozzle mounted under the washing nozzle; a driving motor driving the washing nozzle and/or the bidet nozzle; a gear train comprising a driving gear connected to the driving motor to transmit rotational force of the driving motor, a driven gear engaged with the driving gear to receive the rotational force from the driving gear, a first nozzle gear integrally formed with the driven gear to reciprocate the washing nozzle, and a second nozzle gear reciprocating the bidet nozzle by receiving the rotational force from the driving gear; and a nozzle case for receiving the washing and bidet nozzles and the gear train.

In a still yet another aspect of the present invention, there is provided a nozzle assembly for a bidet, including: a washing nozzle on a side surface of which a washing key is projected; a bidet nozzle disposed under the washing nozzle, the bidet nozzle being provided at a side surface with a bidet key project; a driving gear connected to the driving motor to receive rotational force, the driving gear comprising an upper gear teeth-forming rib formed in a strip-shape disposed along a front frame and a lower gear teeth-forming rib formed in a strip-shape disposed along a front frame; a first nozzle gear reciprocating the bidet nozzle by receiving the rotational force from the driving gear; and a second nozzle gear reciprocating the washing nozzle by receiving the rotational force from the driving gear.

According to the present invention, since the bidet and washing nozzles are arranged side by side in a vertical direction, the volume of the bidet can be reduced.

Furthermore, since the bidet and washing nozzles are arranged side by side in a vertical direction, the washing and bidet nozzles can be accurately aligned with the anal and genital areas so that the washing water can be accurately sprayed to the anal and genital areas.

In addition, since the washing and bidet nozzle are designed to be advanced regardless of the water pressure, the operation reliability of the bidet can be improved.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
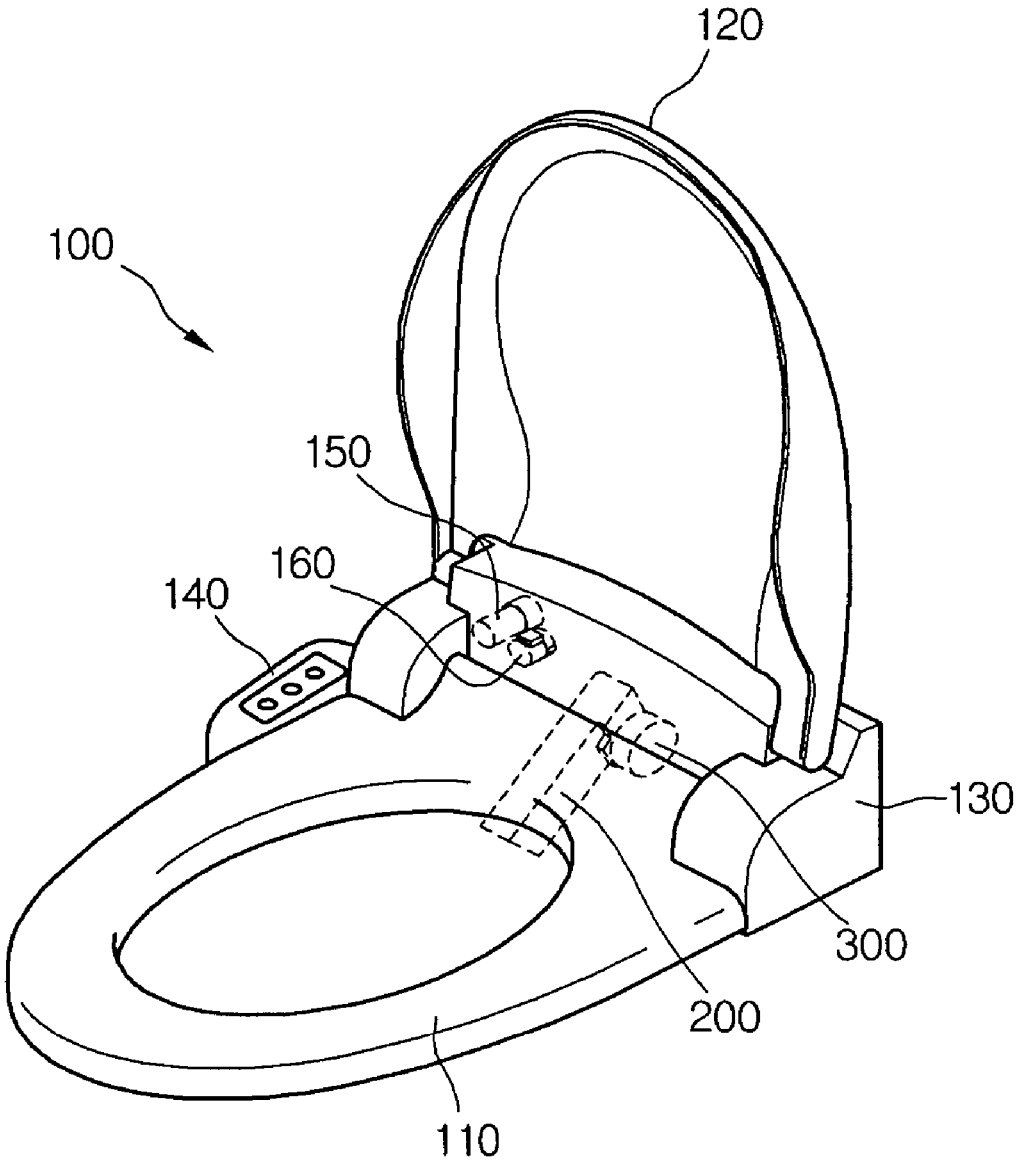
FIG. 1 is a perspective view of a bidet where a nozzle assembly of the present invention is applied.

FIG. 1 shows a perspective view of a bidet where a nozzle assembly of the present invention can be employed.

Referring to FIG. 1, a bidet 100 employing the inventive nozzle assembly 200 includes a seat 110, a cover 120 opening and closing an opening formed on a center of the seat 110, and a component housing chamber 130 on which the seat 110 and the cover 120 are mounted and in which electric components are installed. That is, a nozzle assembly 200 for spraying washing water and a driving motor 300 for reciprocating nozzles of the nozzle assembly 200 are installed in the component-housing chamber 130. A reversible motor may be used as the driving motor 300. A synchronous motor, a direct current (DC) motor, a servo motor, and the like may be also used as the driving motor 300.

The bidet 100 further includes a fluid control valve 160 for dispensing the washing water to one of bidet and washing nozzles of the nozzle assembly 200 and an air pump 150 connected to the fluid control valve 160 to inject air into the fluid control valve 160.

The bidet 100 further includes a control panel 140 on which operational buttons controlling the operation of the bidet 100 are mounted.

The operation of the bidet 100 will be described hereinafter.

First, a user lifts the cover 120 upward and takes the seat 110. After stool, when the user pushes a washing button, the washing nozzle is advanced from the nozzle assembly 200 and washing water is sprayed from an injection hole formed on a tip of the washing nozzle. When the washing operation is finished, the washing nozzle is returned to its initial position.

Meanwhile, when the user pushes a bidet button, the bidet nozzle is advanced from the nozzle assembly 200 and washing water is sprayed from an injection hole formed on a tip of the bidet nozzle. When the washing is finished, the bidet nozzle is returned to its initial position.

Figure 2:
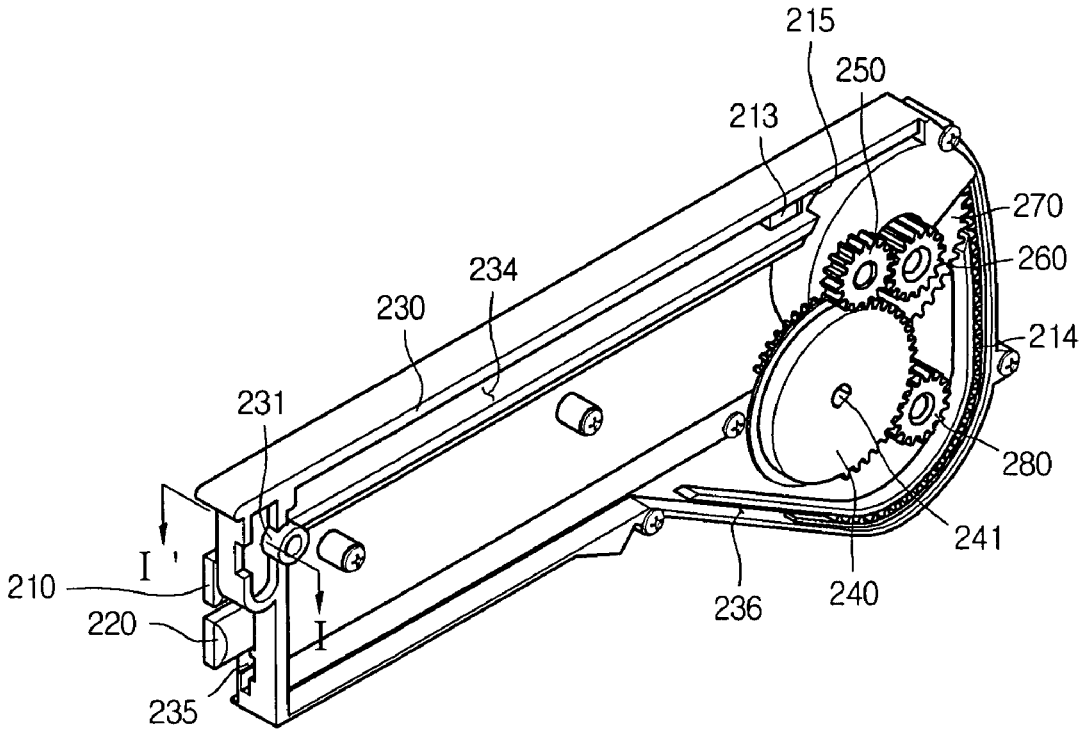
FIG. 2 is a right perspective view of a nozzle assembly according to a first embodiment of the present invention.

FIG. 2 shows a right perspective view of a nozzle assembly according to a first embodiment of the present invention.

Referring to FIG. 2, the inventive nozzle assembly 200 includes a washing nozzle 210 for washing an anal area of the user, a bidet nozzle 220 for washing an genital area of the user, and a nozzle case 230 receiving the washing and bidet nozzles 210 and 220. The bidet nozzle 220 is disposed under the washing nozzle 210.

The nozzle assembly 200 further includes a driving gear 240 connected to the driving motor 300, a connecting gear 250 engaged with the driving gear 240, and a driven gear 260 engaged with the connecting gear 250 to receive rotational force from the driving gear 240. The driving gear 240 is provided with a penetrating hole 241 in which a rotational shaft of the driving motor 300 is inserted. The driving gear 240 will be described in more detail later.

The nozzle assembly 200 further includes a first nozzle gear 270 integrally mounted on a lower portion of the driven gear and engaged with an upper rack wire 214 reciprocating the washing nozzle 210 and a transmission gear 280 engaged with the driving gear 240. The nozzle gear 270 is disposed facing the transmission gear 280. However, the nozzle gear 270 may be axially coupled to the transmission gear 280 so that they can rotate together.

The washing nozzle 210 is provided at a rear-top with a rack wire-coupling end 213. The upper rack wire 214 is provided at an end with an upper rack wire head 215. The upper rack wire head 215 is coupled to the rack wire-coupling end 213 so that the washing nozzle can reciprocate by the movement of the upper rack wire 214.

The nozzle case 230 is provided at an upper portion with a rack wire-coupling end guide groove 234 for guiding the reciprocating motion of the rack wire-coupling end 213. A rear-lower portion of the nozzle case 230 is rounded. A upper rack wire guide groove 236 having a predetermined depth and width is formed along a frame defining the rear wall and rear-bottom of the nozzle case 230. The upper rack wire 214 is located in the upper rack wire guide groove 236. As the first nozzle gear 270 rotates, the upper rack wire 214 reciprocates along the upper rack wire guide groove 236.

The nozzle case 230 is further provided at a lower end with a rack wire-coupling end guide groove 235 functioning as a passage of a reciprocation motion of a lower rack wire heat that will be described later. The nozzle case 230 is further provided at a front end with a washing water introducing tube 231 for introducing washing water for washing the washing and bidet nozzles 210 and 220.

Figure 3:
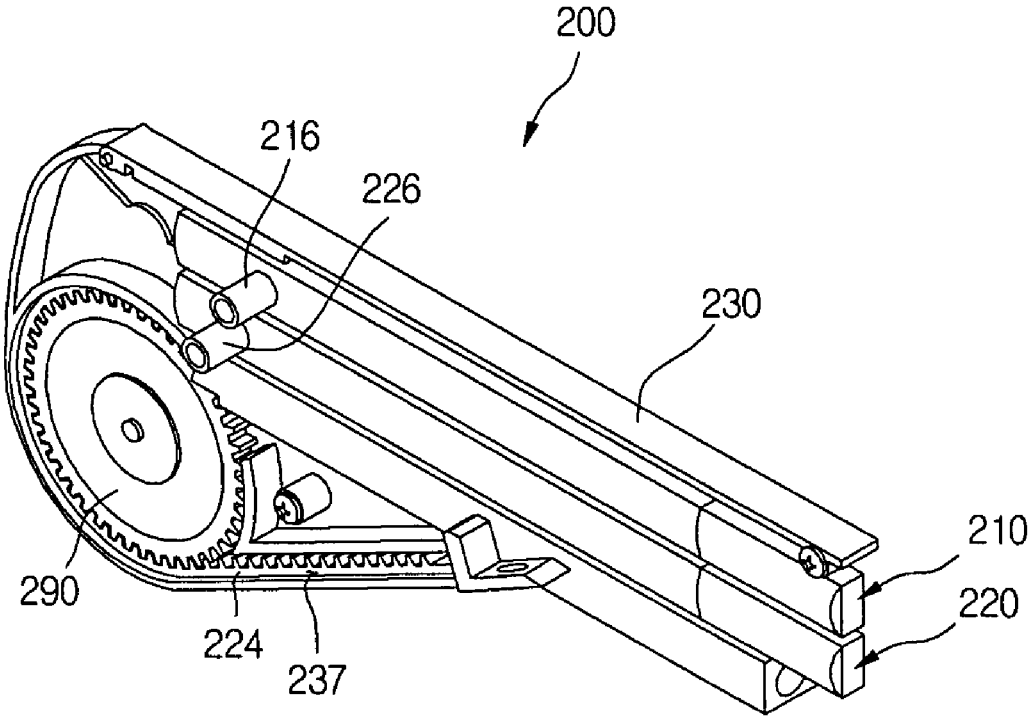
FIG. 3 is a left perspective view of a nozzle assembly according to a first embodiment of the present invention.

FIG. 3 shows a left perspective view of the nozzle assembly.

Referring to FIG. 3, the nozzle assembly further includes a second nozzle gear 290 integrally formed on an opposite side of the transmission gear 280 or axially coupled to the transmission gear 280 and a lower rack wire 224 engaged with the second nozzle gear 290. The lower rack wire 224 reciprocates as the second nozzle gear 290 rotates.

There is provided a lower rack wire guide groove 237 for guiding the reciprocation motion of the lower rack wire 224. The lower rack guide groove 237 having a predetermined width and depth is formed on an opposite side of the upper rack wire guide groove 236. That is, the lower rack guide groove 237 is formed along a rounded frame of the rear lower end of the nozzle case 230.

Meanwhile, as shown in the drawing, hose connection tubes 216 and 226 are respectively formed on rear portions of the washing and bidet nozzles 210 and 220. The hose connection tubes are connected to the fluid passage control valve 160 so that the washing water can be selectively supplied to one of the washing and bidet nozzles 210 and 220.

The operation of the nozzle assembly will be briefly described hereinafter with reference to FIGS. 2 and 3.

When the driving gear 240 connected to the driving motor 300 rotates, the connection gear 250 or the transmission gear 280 rotates. That is, when the connection gear 250 rotates in a state where it is engaged with the driving gear 240, the washing nozzle 210 reciprocates. When the transmission gear 280 rotates in a state where it is engaged with the driving gear 240, the bidet nozzle reciprocates.

When the washing or bidet nozzle 210 or 220 is returned to its initial position after the washing operation is finished, a forced washing operation is performed. For example, after the washing nozzle 210 is advanced and the washing operation for the user's anal area is finished, the washing nozzle 210 is returned into the nozzle case 230. Then, the washing nozzle 210 is forcibly washed by the washing water introduced through the washing water introducing tube 231. This operation is controlled by a microcomputer (not shown).

Figure 4:
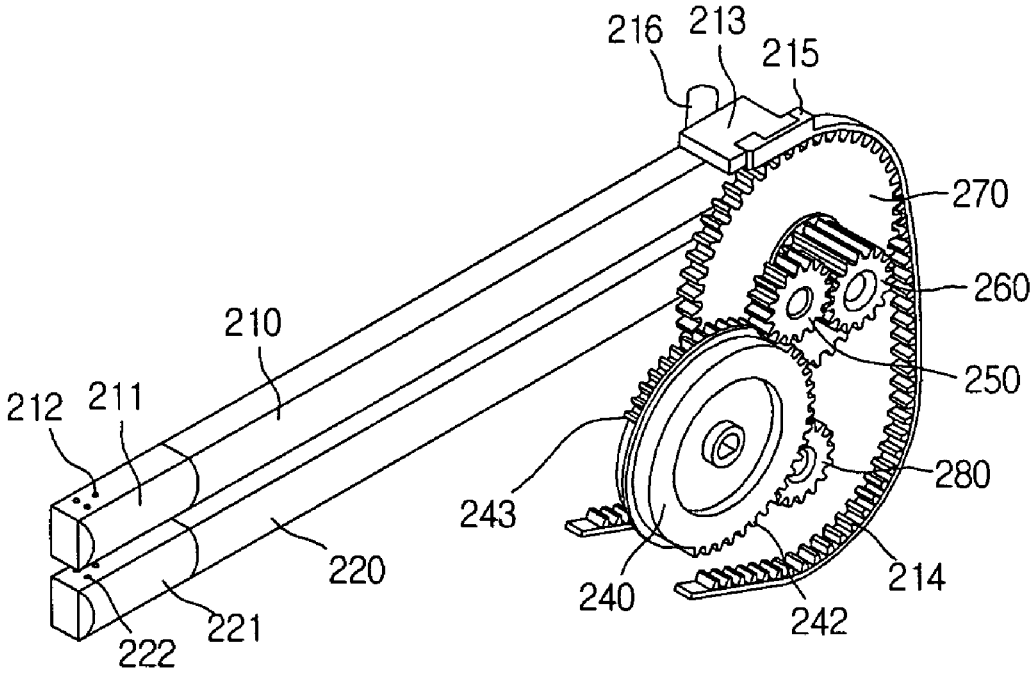
FIG. 4 is a right perspective view of a nozzle assembly where a nozzle case is removed according to a first embodiment of the present invention.
Figure 5:
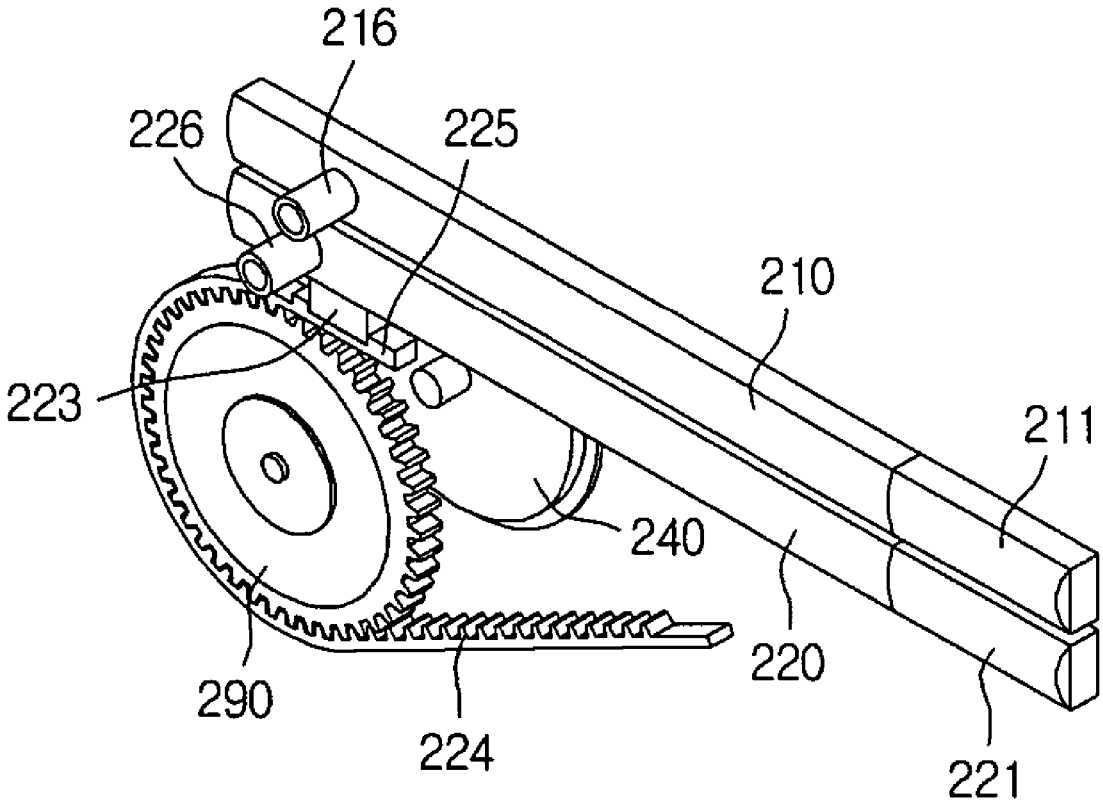
FIG. 5 is a left perspective view of a nozzle assembly where a nozzle case is removed according to a first embodiment of the present invention.

FIGS. 4 and 5 show respectively right and left perspective views of the nozzle assembly where the nozzle case is removed according to a first embodiment of the present invention;

Referring to FIGS. 4 and 5, as described above, the nozzle assembly 200 includes the washing and bidet nozzles 210 that are arranged side by side in the vertical direction.

A nozzle cap 211 provided with an injection hole 212 injecting the washing water is mounted on a front end of the washing nozzle 210. Likewise, a nozzle cap 211 provided with an injection hole 222 is mounted on a front end of the bidet nozzle 220.

In addition, the washing nozzle 210 is provided at a rear end with the rack wire-coupling end 213. The rack wire-coupling end is provided at a middle of a side portion with a notch having a predetermined depth and width, thereby providing projections. The upper rack wire head 215 formed on the end of the upper rack wire 214 is coupled to the rack wire-coupling end 213. That is, the upper rack wire head 215 is also provided at a middle of a side portion with a notch having a predetermined width and depth, thereby providing projections. Therefore, the projections and grooves of the upper rack wire head 215 and the rack wire-coupling ends 213 are engaged with each other. The rack wire 214 is a linear gear extending from the upper rack wire head 215 and provided at an inner circumference with gear teeth engaged with gear teeth of the first nozzle gear 270.

The rack wire-coupling end is formed on a rear-bottom of the bidet nozzle gear 220. Here, it is preferable that the rack wire-coupling ends 213 and 223 are integrally formed with the nozzles 210 and 220, respectively, through an injection molding process.

Meanwhile, the rack wire-coupling end 223 is inserted into a groove formed on a top of the lower rack wire head 225. The lower rack wire 224 is provided at an inner circumference with gear teeth engaged with outer gear teeth of the second nozzle gear 290.

Figure 6:
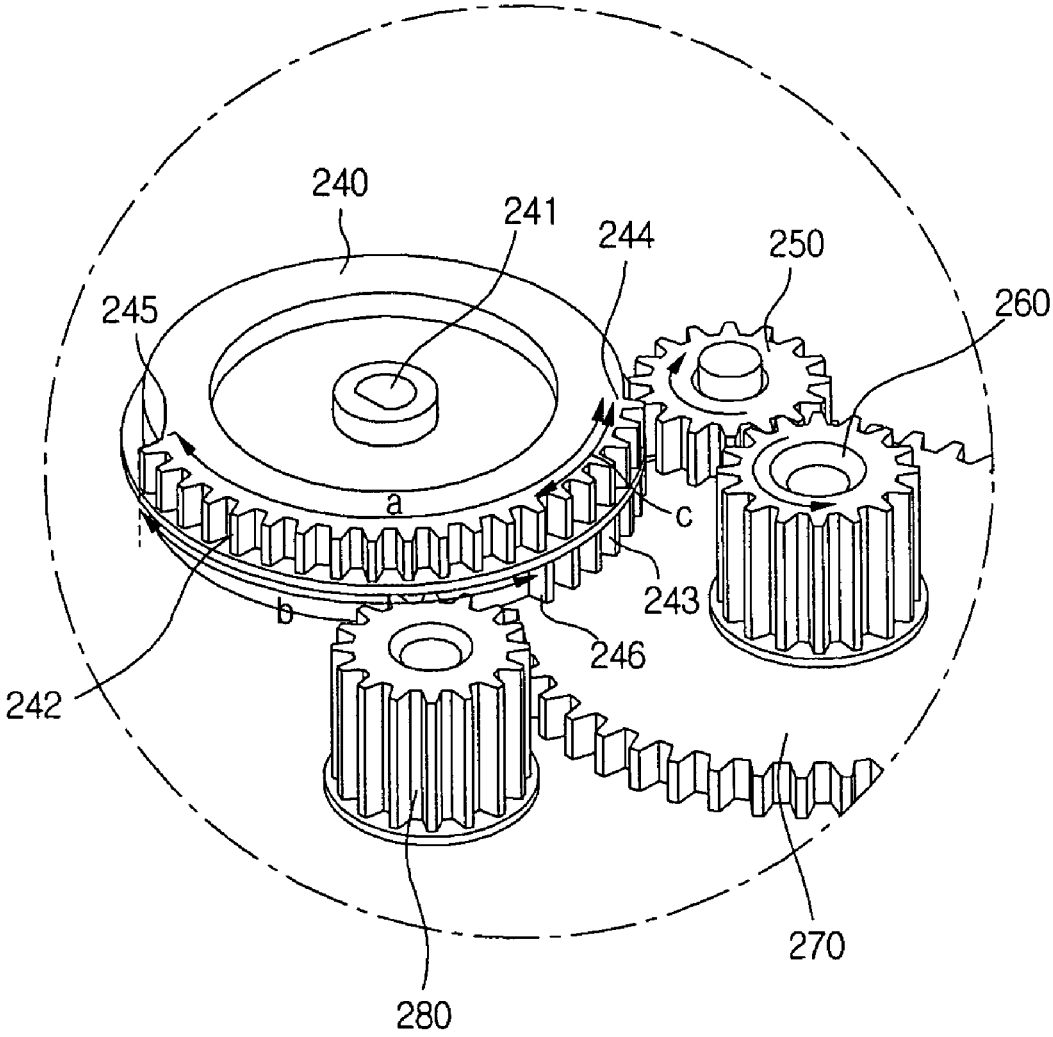
FIG. 6 is an enlarge view of a gear unit of a nozzle assembly according to a first embodiment of the present invention.

FIG. 6 shows an enlarge view of a gear unit of a nozzle assembly according to a first embodiment of the present invention.

Referring to FIG. 6, the bidet nozzle is designed to reciprocate by the rotation of gear connected to the driving motor 300.

The driving gear 240 axially connected to the driving motor 300 is provided at a center with the penetrating hole 241 in which the rotational shaft of the driving motor 300 is inserted. The driving gear 240 is divided into upper and lower halves. The upper half is provided with upper gear teeth 242 and the lower half is provided with lower gear teeth 243.

The upper and lower gear teeth 242 and 243 are partly formed on an outer circumference of the driving gear 240. A start point 244 of the upper gear teeth 242 is distant from a star point 246 of the lower gear teeth 243 by a predetermined distance C. A length (a) from the start point 244 to an ending point 245 of the upper gear teeth 242 is almost identical to a length of the lower gear teeth 243.

The upper gear teeth 242 are engaged with gear teeth of the connection gear 250 and the lower gear teeth 243 are engaged with gear teeth of the transmission gear 280. While the upper gear teeth 242 rotates in a state where they are engaged with the gear teeth of the connection gear 250, the transmission gear 280 is disengaged from the lower gear 243. Accordingly, the transmission gear 280 is not rotated.

On the contrary, while the transmission gear 280 rotates in a state where it is engaged with the lower gear teeth 243, the connection gear 250 is not rotated.

The operation of the connection gear 250 according to the rotation of the gears will be described hereinafter.

When the user pushes the washing button, the driving motor 300 rotates counterclockwise, thereby rotating the driving gear 240 counterclockwise. When the driving gear 240 rotates, the upper gear teeth 242 are engaged with the connection gear 250. That is, gear teeth formed on the start point 244 of the upper gear teeth 242 are engaged with the gear teeth of the connection gear 250 to rotate the connection gear 250.

Meanwhile, the connection gear 250 rotates clockwise and the driven gear 260 engaged with the connection gear 250 rotates counterclockwise. The first nozzle gear 270 integrally connected to a lower end of the driven gear 260 rotates counterclockwise. As the first nozzle gear 270 rotates counterclockwise, the upper rack wire 214 engaged with the first nozzle gear 270 is advanced. As a result, the washing nozzle 210 is projected forward.

At this point, the gears are designed such that the washing nozzle 210 can be maxim ally projected the moment the ending point 245 of the upper gear teeth is engaged with the gear teeth of the connection gear 250 or the moment the ending point 245 of the upper gear teeth is disengaged from the gear teeth of the connection gear 250.

Meanwhile, in a state where the projection of the washing nozzle 210 is maxim ally projected, the washing water is sprayed through the injection hole 212. After the washing operation is finished, the driving more 300 rotates in a reverse direction.

As the driving motor 300 rotates in the reverse direction, the driving gear 240 rotates clockwise until the start point 244 of the upper gear teeth is disengaged from the gear tooth of the connection gear 250, thereby returning the washing nozzle 210 to the initial position.

Here, FIG. 6 shows gear teeth when the washing nozzle 210 is completely inserted into the nozzle case 230. According to features of the upper and lower gear teeth 242 and 243, the moment the start portion of the upper gear teeth 242 is disengaged from the connection gear 250, the start point 246 of the lower gear teeth 243 starts engaging the gear teeth of the transmission gear 280.

Describing in more detail, in a state where the washing nozzle 210 is completely returned to the initial position, when the driving gear 240 starts rotating clockwise, the lower gear teeth 243 are engaged with the gear teeth of the transmission gear 280. The transmission gear 280 rotates counterclockwise and the second nozzle gear 290 integrally connected on the opposite side of the transmission gear 280 rotates counterclockwise. The lower rack wire 224 engaged with the gear teeth of the second nozzle gear 290 is advanced forward along the lower rack wire guide groove 237. As a result, the bidet nozzle 220 having a bottom connected to the lower rack wire 224 is advanced forward. The transmission gear 280 rotates until the moment the ending point (not shown) of the lower gear teeth is engaged with or disengaged from the gear tooth of the transmission gear 280.

Here, while the transmission gear 280 rotates, the connection gear 250 is not rotated.

Figure 7:
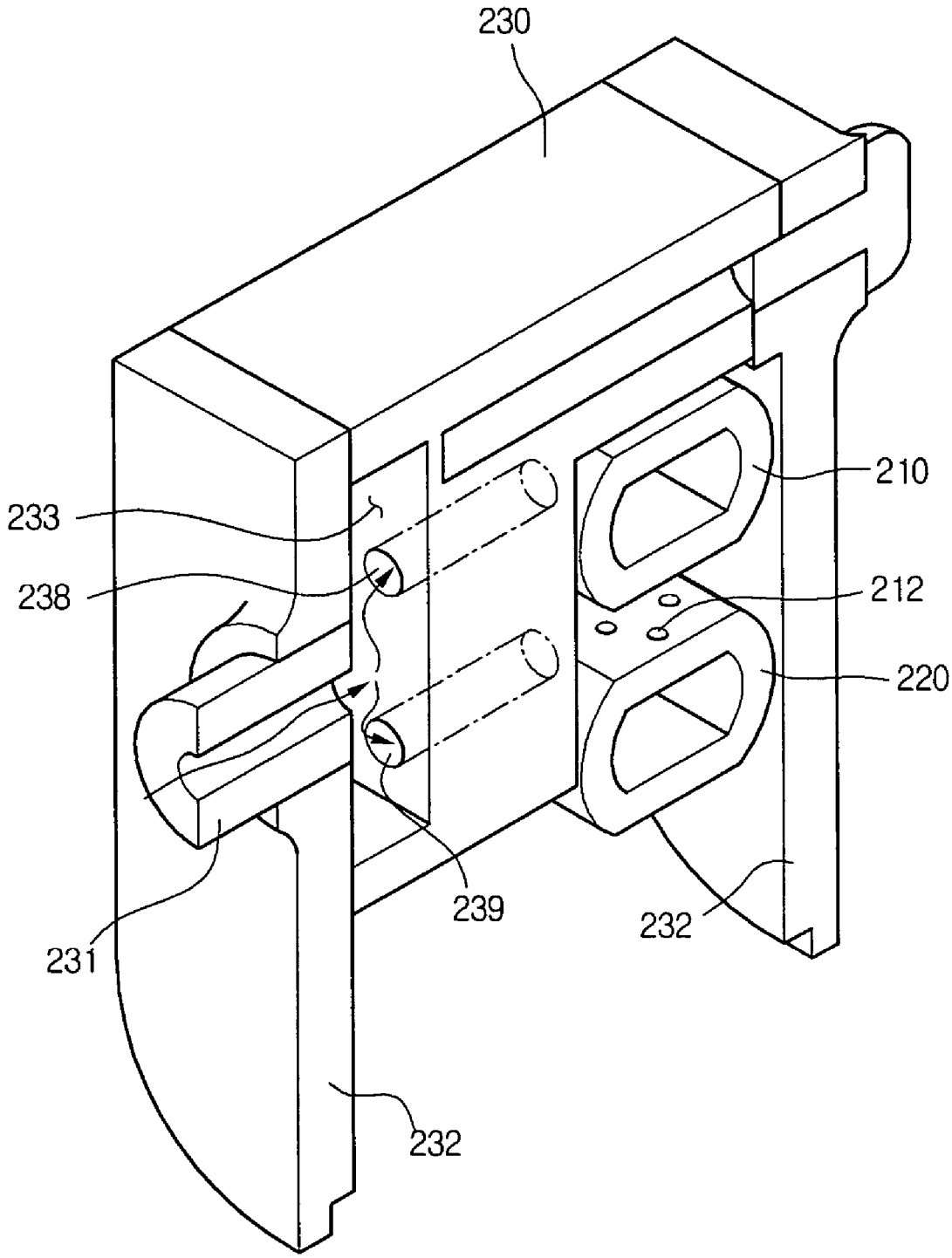
FIG. 7 is a sectional view taken along line I-I' of FIG. 2.

FIG. 7 shows a sectional view taken along line I-I' of FIG. 2.

Referring to FIG. 7, as described above, the nozzle assembly 200 of the present invention includes the nozzle case 230, the washing and bidet nozzles 210 and 220 received in the nozzle case 230, and side covers 232 sealing the both sides of the nozzle case 230. The nozzle case 230 and the side covers 232 are coupled to each other by a plurality of fastening members such as bolts or screws.

The washing water introducing tube 231 is formed penetrating the side cover 232. The washing water introducing tube 231 communicates with a washing water chamber 233 formed on an inner front portion of the nozzle case 230. In order to allow the washing water introduced into the washing water chamber 233 through the washing water introducing tube 231 to wash the nozzle cap 211 of the washing nozzle 210, there is provided an upper fluid passage 238 communicating with the washing nozzle 210. In order to allow the washing water introduced into the washing water chamber 233 through the washing water introducing tube 231 to wash the nozzle cap 221 of the bidet nozzle 220, there is provided a lower fluid passage 239 communicating with bidet nozzle 210.

Generally, the forced washing process for the nozzle caps is performed before one of the washing and bidet nozzles is operated after the other of the washing and bidet nozzles is operated. Accordingly, when one the washing and bidet nozzles is returned after being operated, the washing water is introduced into the washing chamber 233 through the washing water introducing tube 231 and directed along one of the upper and lower fluid passages 238 and 239 to wash one of the washing and bidet nozzles 210 and 220.

Figure 8:
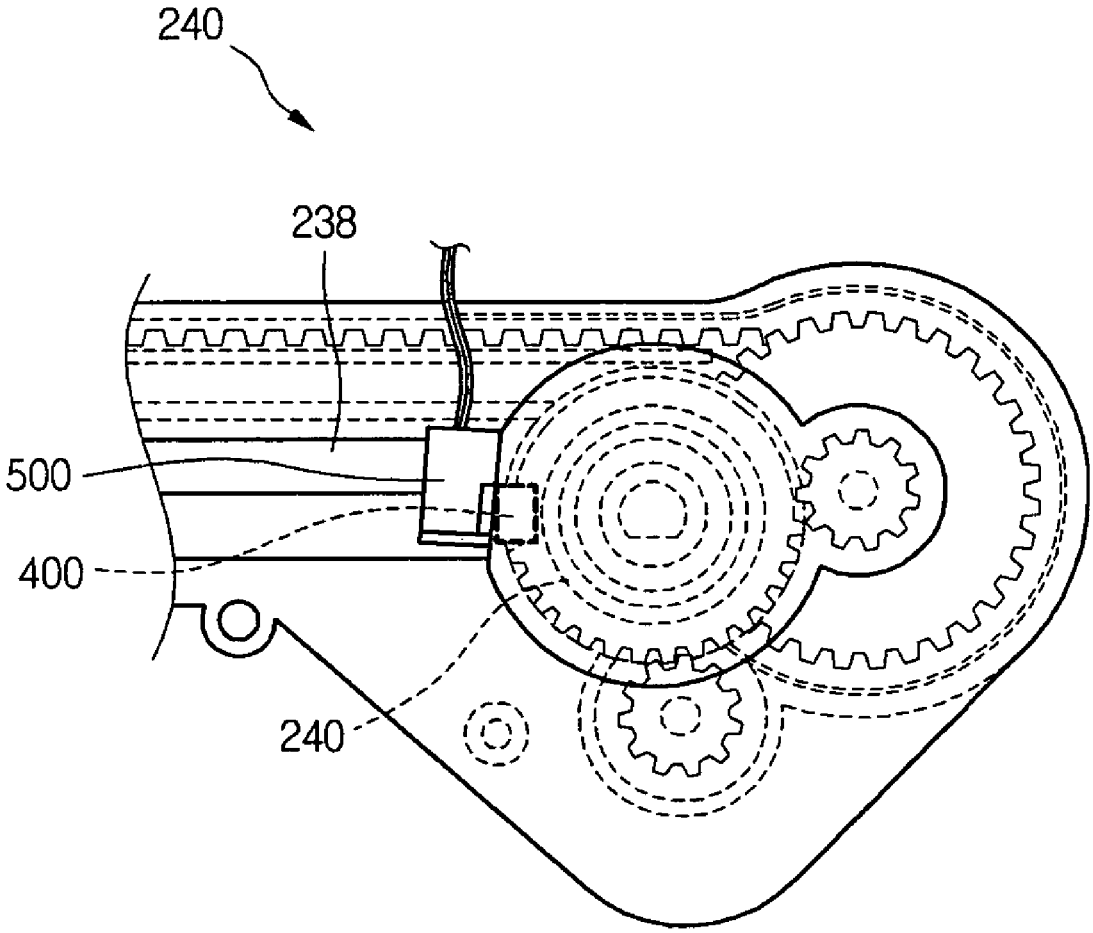
FIG. 8 is a right side view of a nozzle assembly according to a second embodiment of the present invention.
Figure 9:
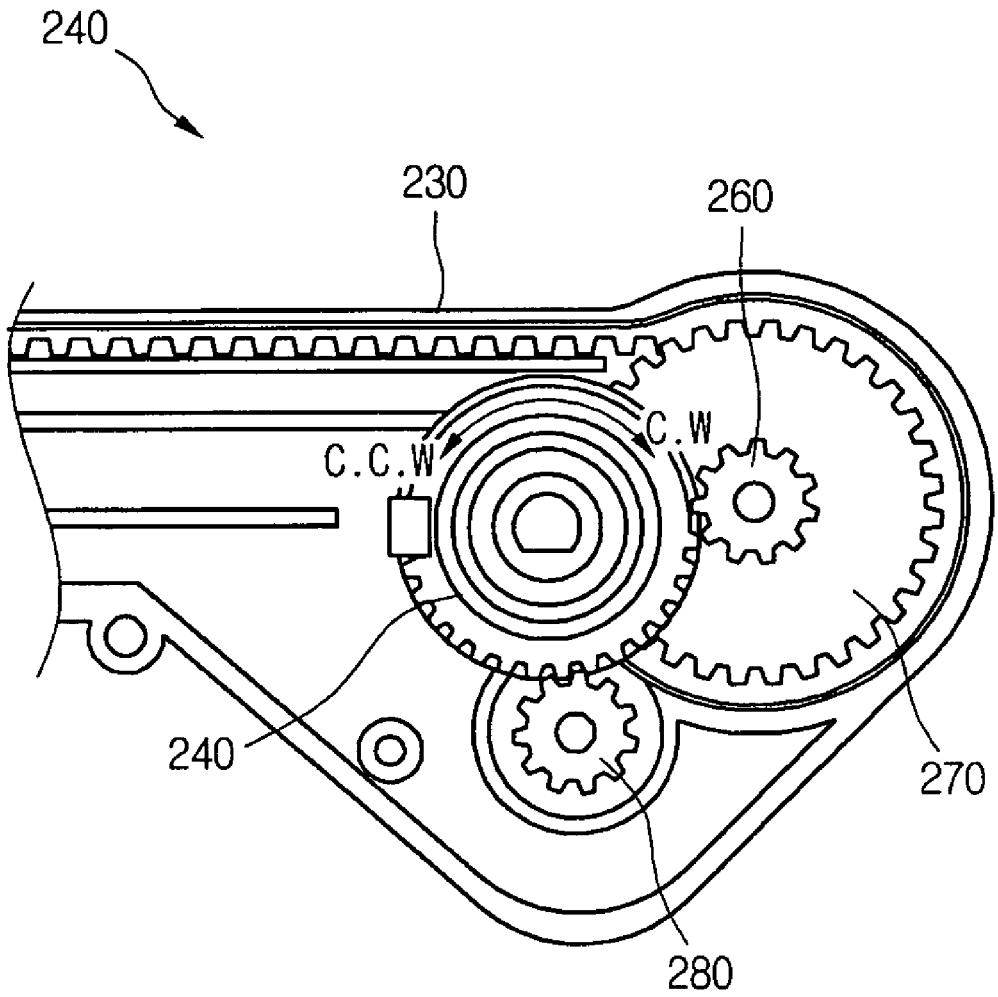
FIG. 9 is a right side view of a gear train of a nozzle assembly according to a second embodiment of the present invention.

FIG. 8 shows a right side view of a nozzle assembly according to a second embodiment of the present invention and FIG. 9 shows a right side view of a gear train of a nozzle assembly according to a second embodiment of the present invention.

Referring first to FIG. 8, in this embodiment, the connection gear 250 connecting the driving gear 240 to the driven gear 260 is omitted and a position sensor detecting a position of the driving gear 240 is further provided.

That is, according to a feature of a nozzle assembly of this embodiment, a structure for preventing the washing and bidet nozzles 210 and 220 from being simultaneously projected forward. This will be described later.

The components identical to those described in the first embodiment will not be described in this embodiment.

A nozzle assembly of this embodiment includes a nozzle case 230, nozzle case cover 238 attached on both sides of the nozzle case 230, and a position sensor 500 disposed on an outer surface of the nozzle case cover 230 to detect the position of the driving gear 240.

A magnet 400 is attached on an outer circumference of the driving gear 240 to allow the position sensor 500 to detect the position of the driving gear 240. As shown in the drawing, the position sensor 50 is installed close to the magnet 400 so that it can accurately detect the position of the magnet 400 when the driving gear 240 rotates. The position detecting means of the driving gear 240 is not limited to the position sensor 500 and the magnet 400. A variety of means can be used to detect the position of the driving gear 240.

Referring to FIG. 9, the gear train of the nozzle assembly of this embodiment includes the driving gear 240 axially connected to the driving motor 300, a driven gear 260 engaged with the driving gear 240, a first nozzle gear 270 integrally formed on a lower portion of the driven gear 260, a transmission gear engaged with the driving gear 240, and a second nozzle gear 290 integrally formed on a rear surface of the transmission gear 280.

According to another feature of this embodiment, rotational force of the driving gear 240 is directly transmitted to the driven gear 260 without passing through the connection gear 250. As a result, the rotational direction of the driven gear 260 is opposite to that of the driving gear 240.

Figure 10:
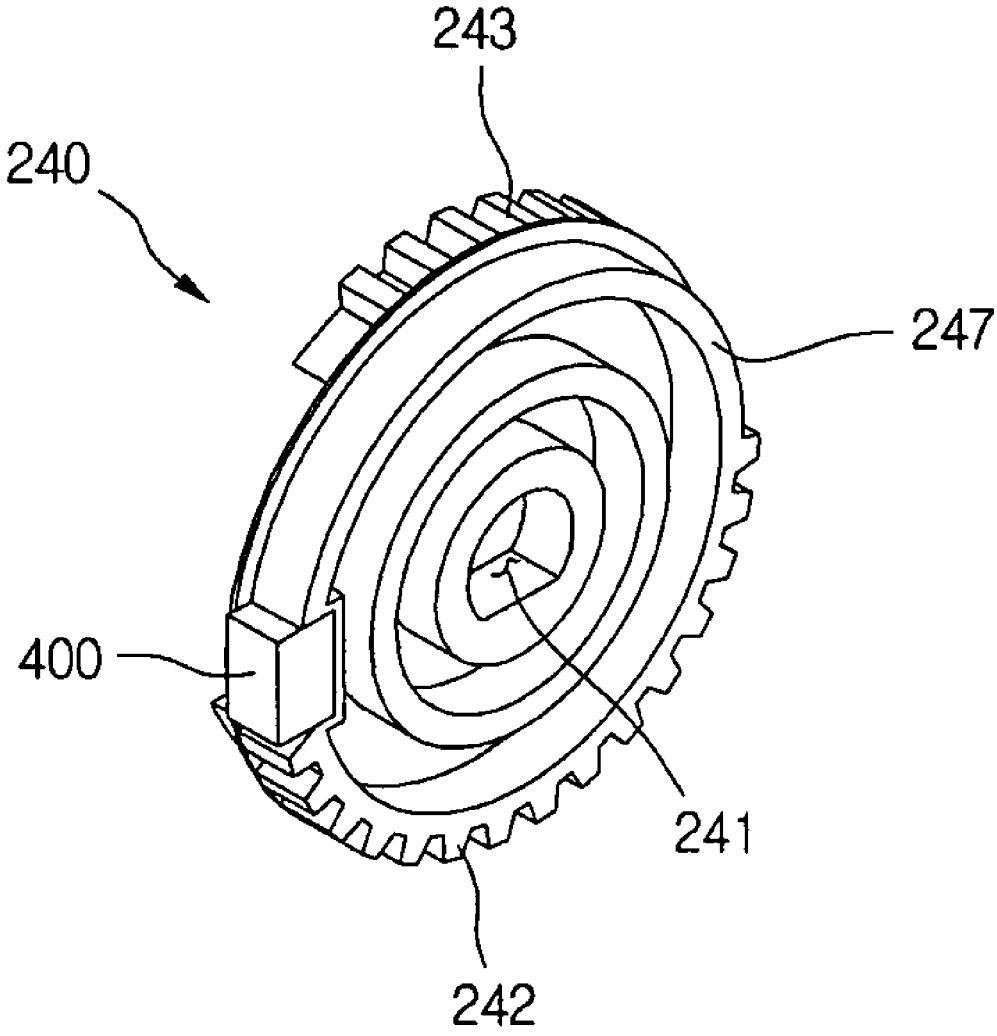
FIG. 10 is a front view of a driving gear of a nozzle assembly according to a second embodiment of the present invention.
Figure 11:
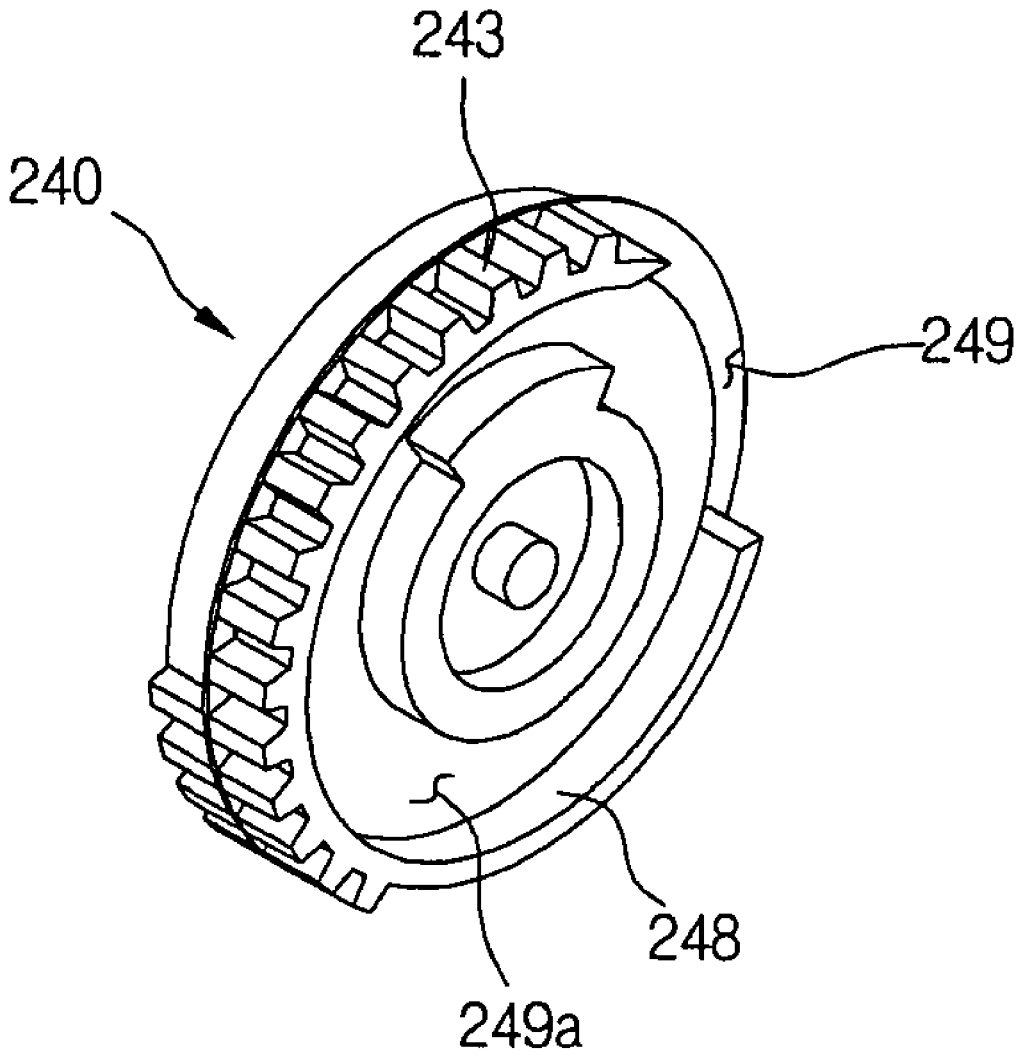
FIG. 11 is a rear view of a driving gear depicted in FIG. 10.

FIGS. 10 and 11 show front and rear views of the driving gear of the nozzle assembly according to a second embodiment of the present invention, respectively.

Referring to FIGS. 10 and 11, the magnet 400 having a predetermined size is mounted on a front frame of the driving gear 240 so that the position sensor 500 can detect the position of the driving gear 240.

The driving gear 240 is provided an upper gear teeth-forming rib 247 for forming gear teeth 242 on the front frame and a lower gear teeth-forming rib 248 for forming gear teeth 243 on a rear frame.

A key groove 249*a* having a predetermined width is formed inside the lower gear teeth-forming rib 240. The lower gear teeth-forming rib 240 is not formed in an endless circle, having spaced first and second ends. A space defined between the first and second ends of the lower gear teeth-forming rib 240 functions as a withdraw opening 249 through which a washing or bidet key that will be described later will be withdrawn.

Describing in more detail with reference to FIG. 9, the upper gear teeth 242 are partly formed on a lower portion of the upper gear teeth-forming rib 247 while the lower gear teeth 243 are partly formed on an upper portion of the upper gear teeth-forming rib 248. The upper gear teeth 242 are engaged with the gear teeth of the driven gear 260 and the lower gear teeth 243 are engaged with the gear teeth of the transmission gear 280. As a result, in a state where the washing and bidet nozzles 210 and 220 are inserted into the nozzle case 230, when the driving gear 240 rotates counterclockwise, the driven gear 260 rotates clockwise. The first nozzle gear 270 integrally connected to the lower portion of the driven gear 260 rotates clockwise, thereby moving the upper rack wire 214 wound around the frame of the first nozzle gear 270 to allow the bidet nozzle 220 to be advanced forward.

Meanwhile, when the driving gear 240 rotates clockwise, the transmission and second nozzle gears 280 and 290 rotate counterclockwise. The lower rack wire 224 wound around the second nozzle gear 290 rotates to allow the washing nozzle 210 to be advanced forward.

The advancing of the nozzles according to the rotation of the driving gear 240 will be described more in detail hereinafter.

Figure 12:
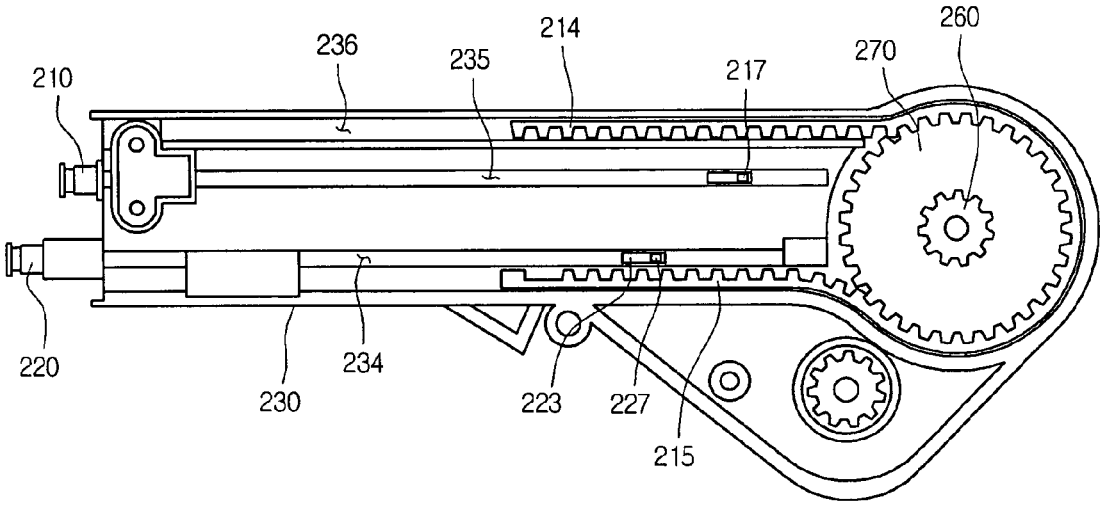
FIG. 12 is a right side view of a nozzle assembly according to a second embodiment of the present invention.
Figure 13:
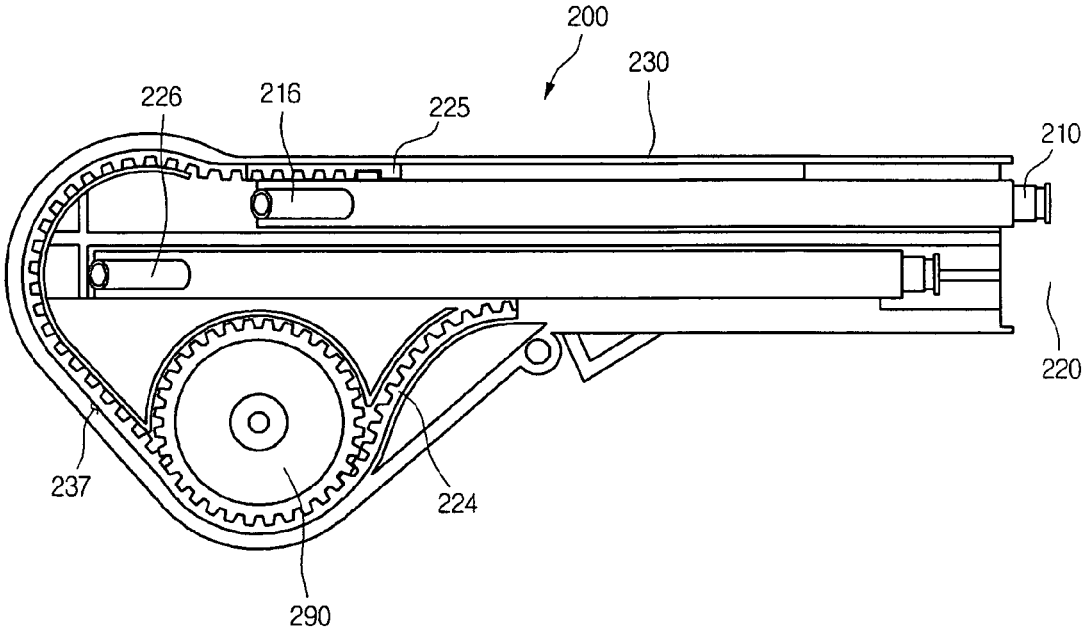
FIG. 13 is a left side view of a nozzle assembly according to a second embodiment of the present invention.

FIG. 12 shows a right side view of a nozzle assembly according to a second embodiment of the present invention and FIG. 13 shows a left side view of a nozzle assembly according to a second embodiment of the present invention.

Referring first to FIG. 12, as described above, the gear train and rack wire guide structure of the nozzle assembly of this embodiment are different from those of the first embodiment.

According to the nozzle assembly of this embodiment, the upper rack wire 214 wound around the outer circumference of the first nozzle gear 270 is connected to the bidet nozzle 220. That is, a rack wire-coupling end 223 formed on a portion of the outer circumference of the bidet nozzle 220 is coupled to an upper rack wire head 215 formed on a lower end of the upper nozzle.

The upper end of the upper rack wire 214 reciprocates in an upper rack wire guide groove 236 formed on an upper portion of an insertion portion in which the washing nozzle 210 is inserted. The lower end of the upper rack wire 214 reciprocates in a lower rack wire guide groove 234 formed on a lower portion of the insertion portion in which the bidet nozzle 220 is inserted.

The washing key guide groove 235 having a predetermine length is formed on a middle portion of the nozzle case 230 between the bidet nozzle 220 and the washing nozzle 210. The washing key 217 reciprocates in the washing key guide groove 235.

In addition, another rack wire-coupling end guide groove 234 is further formed on the nozzle case 230 under the washing key guide groove 235 so that the rack wire-coupling key 217 formed on a side surface of the bidet nozzle 220 can reciprocate in the rack wire-coupling end guide groove 234.

Describing in more detail, the washing nozzle 210 is provided at an upper-outer circumference with the rack wire-coupling end 213 and at a side surface with the washing key 217 while the bidet nozzle 220 mounted under the washing nozzle 210 is provided with a bidet key 227 integrally extending from a top of the rack wire-coupling end 223.

Referring to FIG. 13, the lower rack wire is wound around the outer circumference of the second nozzle gear 290. The lower rack wire guide groove 237 guiding the movement of the lower rack wire 224 is formed on a left side of the nozzle case 230. That is, the lower rack wire guide groove 237 extends from the upper end of the nozzle case 230 along the frame of the nozzle case 230. The lower rack wire 224 inserted in the lower rack wire guide groove 237 is provided at an upper end with the lower rack wire head 225. The lower rack wire head 225 is coupled to the rack wire-coupling end 213 formed on the top of the washing nozzle 210. Accordingly, the washing nozzle 210 is advanced or inserted according to the rotational direction of the second nozzle gear 290. The washing key 217 reciprocating along the washing key guide groove 235 is formed to cross the rack wire-coupling end 213 at right angles.

Figure 14:
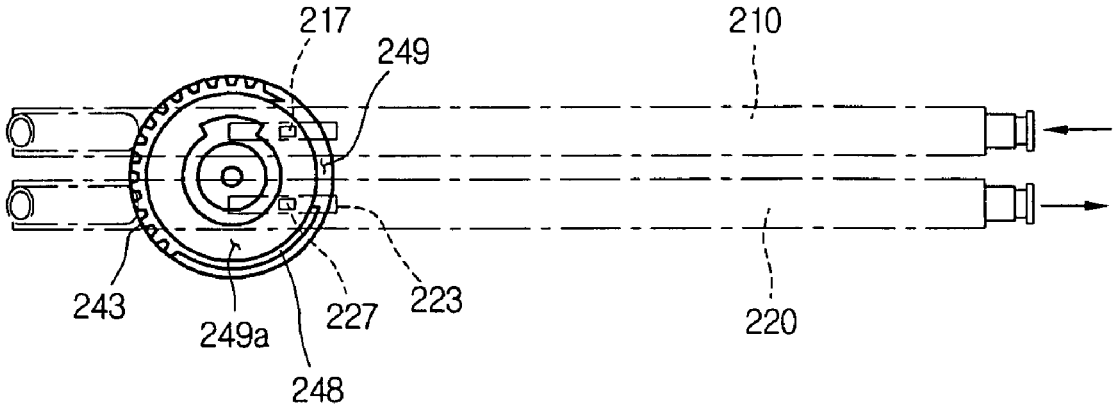
FIG. 14 is a view illustrate a state before washing and bidet nozzles of a nozzle assembly according to a second embodiment of the present invention are operated by being engaged with a driving gear.

FIG. 14 illustrates a state before the washing and bidet nozzles of the nozzle assembly according to a second embodiment of the present invention are operated by being engaged with the driving gear.

Referring to FIG. 14, the washing key 217 formed on the outer circumference of the washing nozzle 210 and the bidet key 227 formed on the outer circumference of the bidet nozzle 220 are inserted in a key groove formed on the rear surface of the driving gear 240. The keys 217 and 227 are advanced or inserted through the key withdraw opening 249 defined between the opposite ends of the upper gear teeth-forming rib 240. When one of the washing and bidet keys 217 and 227 is advanced through the key withdraw opening 249, the other is fixed by being hooked on an inner circumference of the lower gear teeth-forming rib 248.

Accordingly, even when a washing water supply hose connected, to the nozzles 210 and 220 twines, the advancement of one of the nozzles is not affected by the other. This will be described in more detail hereinafter.

Figure 15:
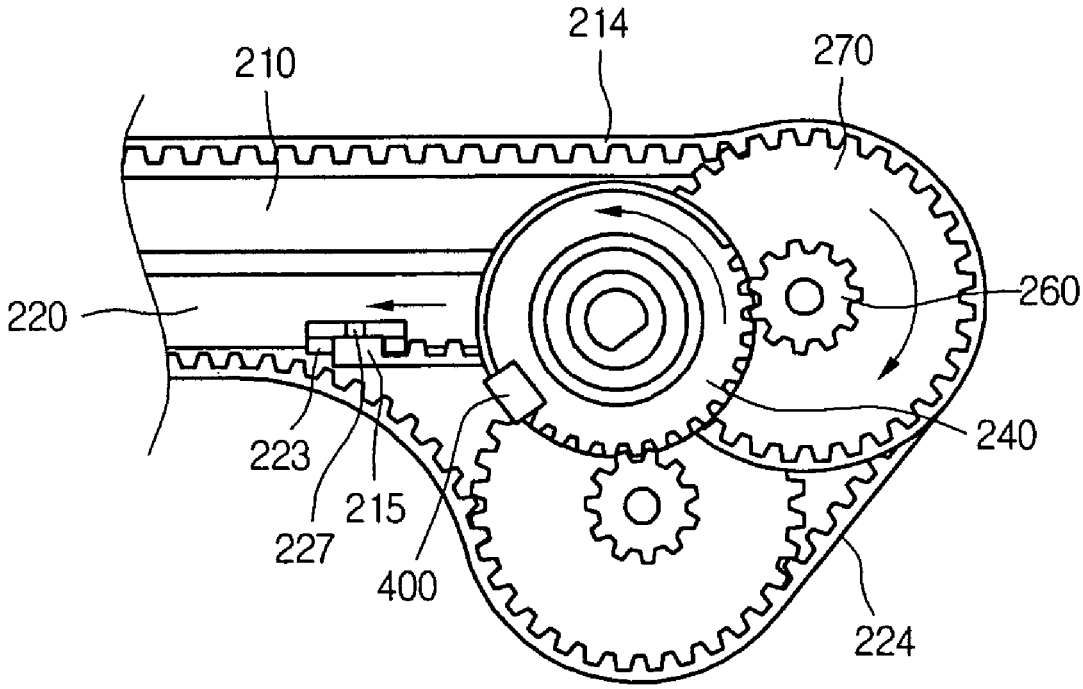
FIG. 15 is a view illustrating a projecting process of a bidet nozzle of a nozzle assembly according to a second embodiment of the present invention.
Figure 16:
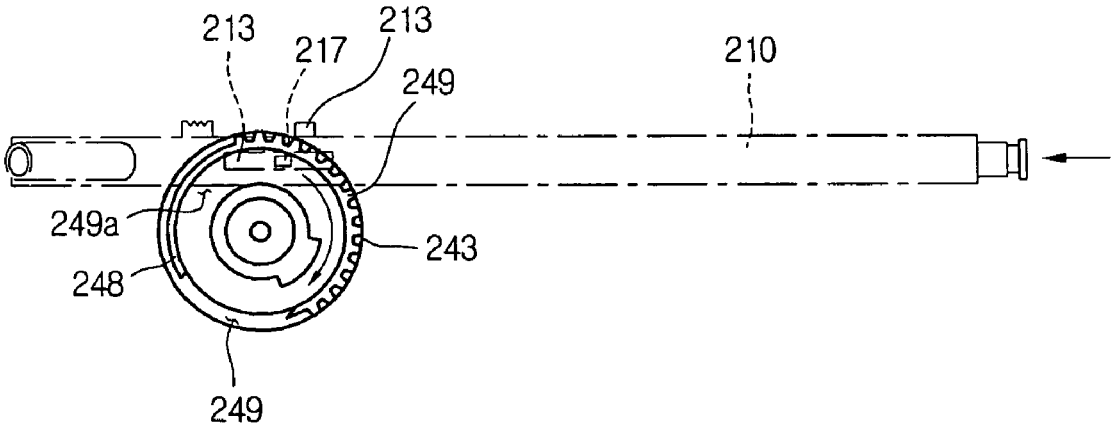
FIG. 16 is a view illustrating a state of a washing nozzle when a bidet nozzle is projected.

FIG. 15 illustrates an advancing process of the bidet nozzle of the nozzle assembly according to a second embodiment of the present invention and FIG. 16 illustrates a state of the washing nozzle when the bidet nozzle is projected.

Referring to FIGS. 15 and 16, when the first nozzle gear 270 rotates clockwise, the lower end of the upper rack wire 214 is advanced forward the nozzle case 230, thereby allowing the bidet nozzle 220 to be advanced forward.

Describing in more detail, when the driving gear 240 connected to the driving motor 300 rotates counterclockwise, the connection gear 260 rotates clockwise. The first nozzle gear 270 integrally formed with the connection gear 260 rotates clockwise. By the clockwise rotation of the first nozzle gear 270, the upper rack wire 214 moves. The bidet key 227 formed on the side surface of the bidet nozzle 220 is advanced forward through the key withdraw opening 290 formed on the rear surface of the driving gear 240.

At this point, as shown in FIG. 16, the washing key 217 formed on the side surface of the washing nozzle 210 is hooked on the inner circumference of the lower gear teeth-forming rib 248. Accordingly, when the driving gear 240 in a neutral state rotates in an arrow direction, the washing key 217 is caught on the key groove 249*a*.

Accordingly, the washing nozzle 210 is not affected by the advancing of the bidet nozzle 220 but maintained in its insertion state.

Figure 17:
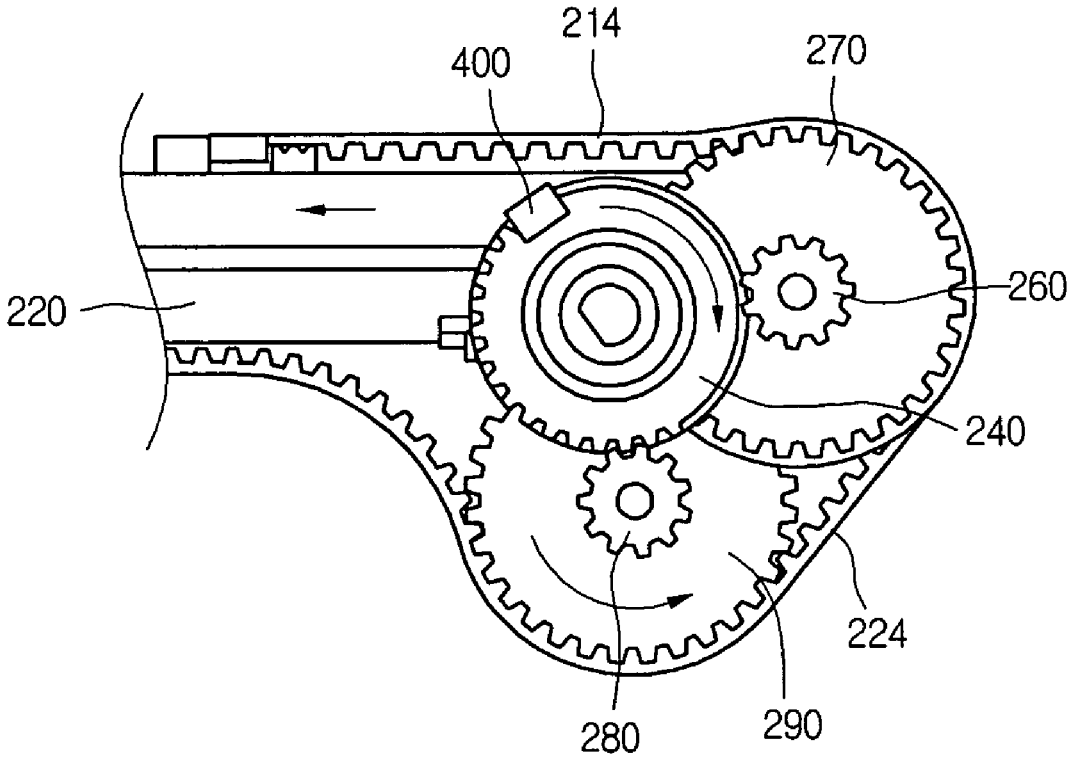
FIG. 17 is a view illustrating a projecting process of a washing nozzle of a nozzle assembly according to a second embodiment of the present invention.

FIG. 17 illustrates a projecting process of the washing nozzle of the nozzle assembly according to a second embodiment of the present invention and FIG. 16 illustrates a state of the bidet nozzle when the washing nozzle is advanced.

Figure 18:
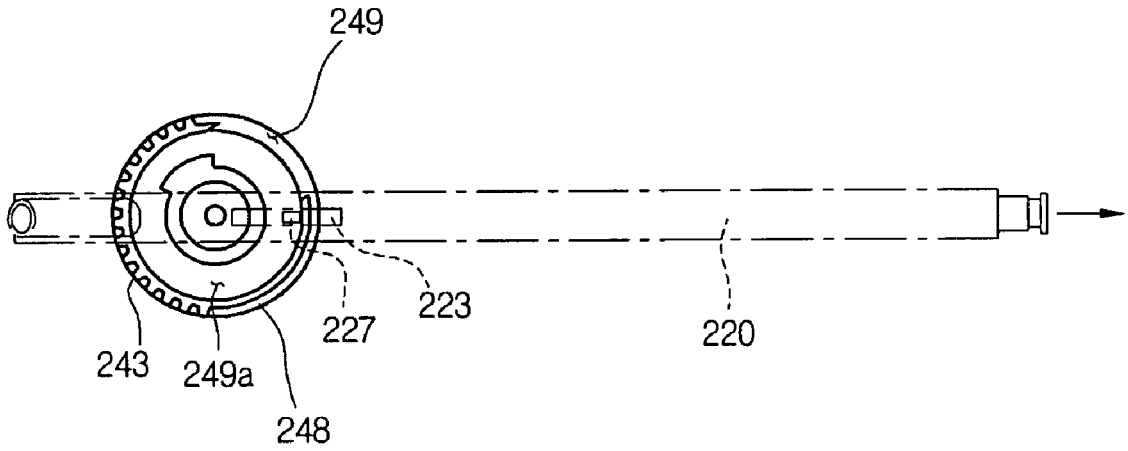
FIG. 18 is a view illustrating a state of a bidet nozzle when a washing nozzle is projected.

Referring to FIGS. 17 and 18, when the driving gear 240 rotates clockwise, the transmission gear 280 engaged with the driving gear 240 rotates counterclockwise and the second nozzle gear integrally formed with the transmission gear 280 rotates counterclockwise, thereby moving the lower rack wire 224 wound around the outer circumference of the second nozzle gear 290.

Since the lower rack wire head 225 formed on the upper end of the lower rack wire 224 is coupled to the rack wire-coupling end 213 formed on the top of the washing nozzle 210, the upper end of the lower rack wire 224 is advanced forward to allow the washing nozzle 210 to be advanced forward.

The washing key 217 formed on the side surface of the washing nozzle 210 is advanced forward through the key withdraw opening 249 formed on the rear surface of the driving gear 240. On the contrary, the bidet key 227 formed on the side surface of the bidet nozzle 220 is, as shown in FIG. 18, is hooked on the inner circumference of the lower gear teeth-forming rib 248.

By the above-described structure, the advancing of one of the washing and bidet nozzles is not affected by the other.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A nozzle assembly for a bidet, comprising:

a washing nozzle;

a bidet nozzle mounted under the washing nozzle;

a driving motor driving the washing nozzle and/or the bidet nozzle;

a gear train comprising a driving gear connected to the driving motor to transmit rotational force of the driving motor, a first nozzle gear reciprocating the washing nozzle by receiving the rotational force from the driving gear, and a second nozzle gear reciprocating the bidet nozzle by receiving the rotational force from the driving gear;

a nozzle case for receiving the washing and bidet nozzles and the gear train; and a rack wire provided at an inner circumference with gear teeth and connected to a rear end of the washing nozzle and/or the bidet nozzle, the rack wire being engaged with the first nozzle gear and/or the second nozzle gear.

2. The nozzle assembly according to claim 1, wherein the gear train further comprises a connection gear transmitting the rotational force of the driving gear to the first nozzle gear.

3. The nozzle assembly according to claim 1, wherein the gear train further comprises a driven gear transmitting the rotational force of the driving gear to the first nozzle gear.

4. The nozzle assembly according to claim 1, wherein the gear train further comprises a driven gear integrally formed with the first nozzle gear to receive the rotational force from the driving gear.

5. The nozzle assembly according to claim 1, wherein the gear train further comprises a transmission gear transmitting the rotational force of the driving gear to the second nozzle gear.

6. The nozzle assembly according to claim 1, wherein the gear train further comprises a transmission gear integrally formed with the second nozzle gear and engaged with the driving gear.

7. The nozzle assembly according to claim 1, wherein the driving gear is divided into upper and lower halves respectively provided with gear teeth by a predetermined length.

8. The nozzle assembly according to claim 1, wherein the nozzle case is provided at a front-side portion with a washing water introducing tube, a washing water chamber for storing the washing water introduced through the washing water introducing tube, and a fluid passage for communicating the washing water chamber with the washing nozzle and/or the bidet nozzle.

9. The nozzle assembly according to claim 1, wherein the washing nozzle is provided at a rear-top with a rack wire-coupling end and the nozzle case is provided with a guide groove for guiding a reciprocating motion of the rack wire-coupling end.

10. The nozzle assembly according to claim 1, wherein the bidet nozzle is provided at a rear-bottom with a rack wire-coupling end and the nozzle case is provided with a guide groove for guiding a reciprocating motion of the rack wire-coupling end.

11. A nozzle assembly for a bidet, comprising:

washing and bidet nozzles that are arranged side by side in a vertical direction;

rack wires respectively connected to rear ends of the washing and bidet nozzles;

a first nozzle gear having gear teeth engaged with the rack wire connected to the rear end of the washing nozzle;

a second nozzle gear having gear teeth engaged with the rack wire connected to the rear end of the bidet nozzle; and a driving gear transmitting rotational force to the first nozzle gear and/or the second nozzle gear.

12. The nozzle assembly of claim 11, further comprising: a connection gear engaged with the driving gear; and a driven gear engaged with the connection gear and integrally formed with the first nozzle gear.

13. The nozzle assembly according to claim 11, further comprising a transmission gear integrally formed with the second nozzle gear and engaged with the driving gear.

14. The nozzle assembly according to claim 11, wherein the driving gear is divided into upper and lower halves respectively having upper and lower gear teeth, the upper gear teeth being engaged with the connection gear and the lower gear teeth being engaged with the transmission gear.

15. The nozzle assembly according to claim 14, wherein the upper and lower gear teeth are partly formed on an outer circumference of the driving gear.

16. A nozzle assembly for a bidet, comprising:

a washing nozzle;

a bidet nozzle mounted under the washing nozzle;

a driving motor driving the washing nozzle and/or the bidet nozzle;

a gear train comprising a driving gear connected to the driving motor to transmit rotational force of the driving motor, a driven gear engaged with the driving gear to receive the rotational force from the driving gear, a first nozzle gear integrally formed with the driven gear to reciprocate the washing nozzle, and a second nozzle gear reciprocating the bidet nozzle by receiving the rotational force from the driving gear; and a nozzle case for receiving the washing and bidet nozzles and the gear train.

17. The nozzle assembly according to claim 16, wherein the gear train further comprises a transmission gear integrally formed with the second nozzle gear and engaged with the driving gear to receive the rotational force.

18. The nozzle assembly according to claim 16, further comprising a magnet mounted on an outer circumference of the driving gear; and a position sensor detecting a position of the magnet.

19. The nozzle assembly according to claim 18, wherein the position sensor is mounted on a side surface of the nozzle assembly to correspond to the magnet.

20. The nozzle assembly according to claim 16, further comprising: a rack wire wound around the first nozzle gear, the rack wire having a first end connected to the bidet nozzle so that the bidet nozzle can be advanced or returned by the rotation of the first nozzle gear.

21. The nozzle assembly according to claim 20, wherein the rack wire connected to the bidet nozzle is provided at the first end with a rack wire head; and the bidet nozzle is provided at an outer circumference with a rack wire head coupling end coupled to the rack wire head.

22. The nozzle assembly according to claim 16, wherein further comprising: a rack wire wound around the second nozzle gear, the rack wire having a first end connected to the washing nozzle so that the washing nozzle can be advanced or returned by the rotation of the second nozzle gear.

23. The nozzle assembly according to claim 22, wherein the rack wire connected to the washing nozzle is provided at the first end with a rack wire head; and the washing nozzle is provided at an outer circumference with a rack wire head-coupling end coupled to the rack wire head.

24. A nozzle assembly for a bidet, comprising:

a washing nozzle on a side surface of which a washing key is projected;

a bidet nozzle disposed under the washing nozzle, the bidet nozzle being provided at a side surface with a bidet key project;

a driving gear connected to a driving motor to receive rotational force, the driving gear comprising an upper gear teeth-forming rib formed in a strip-shape disposed along a front frame and a lower gear teeth-forming rib formed in a strip-shape disposed along a front frame;

a first nozzle gear reciprocating the bidet nozzle by receiving the rotational force from the driving gear; and a second nozzle gear reciprocating the washing nozzle by receiving the rotational force from the driving gear.

25. The nozzle assembly according to claim 24, wherein the lower gear teeth-forming rib is provided at an inside with a key groove receiving the washing key and/or the bidet key.

26. The nozzle assembly according to claim 24, wherein opposite ends of the lower gear teeth-forming rib are distance from each other to define a key withdraw opening between the opposite ends.

27. The nozzle assembly according to claim 24, wherein when the driving gear rotates clockwise, the second nozzle gear rotates counterclockwise; when the second nozzle gear rotates counterclockwise, the washing nozzle is advanced forward; and when the washing nozzle is advanced forward, the bidet nozzle is fixed by the bidet key hooked inside the lower gear teeth-forming rib.

28. The nozzle assembly according to claim 24, wherein when the driving gear rotates counterclockwise, the first nozzle gear rotates clockwise; when the first nozzle gear rotates clockwise, the bidet nozzle is advanced forward; and when the bidet nozzle is advanced forward, the washing nozzle is fixed by the washing key hooked inside the lower gear teeth-forming rib.

* * * * *